US007367209B2

(12) United States Patent
Ritter et al.

(10) Patent No.: US 7,367,209 B2
(45) Date of Patent: May 6, 2008

(54) OPTIMISED SHIFT STRATEGY AS A FUNCTION OF STRIP WIDTH

(75) Inventors: Andreas Ritter, Haiger (DE); Rüdiger Holz, Neunkirchen (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/583,293

(22) PCT Filed: Nov. 11, 2004

(86) PCT No.: PCT/EP2004/012796

§ 371 (c)(1),
(2), (4) Date: Jun. 17, 2006

(87) PCT Pub. No.: WO2005/058517

PCT Pub. Date: Jun. 30, 2005

(65) Prior Publication Data

US 2007/0101792 A1 May 10, 2007

(30) Foreign Application Priority Data

Dec. 18, 2003 (DE) ..... 103 59 402

(51) Int. Cl.
*B21B 31/18* (2006.01)

(52) U.S. Cl. ..... 72/247; 72/242.4; 72/252.5

(58) Field of Classification Search ..... 72/241.2, 72/242.2, 242.4, 243.6, 247, 252.5; 700/154
See application file for complete search history.

(56) References Cited

U.S. PATENT DOCUMENTS 4,730,475 A * 3/1988 Ginzburg ..... 72/234
4,781,051 A * 11/1988 Schultes et al. ..... 72/247
4,823,585 A * 4/1989 Hishinuma et al. ..... 72/247
5,943,896 A * 8/1999 Rosenthal et al. ..... 72/252.5
6,324,881 B1 12/2001 Benedetti et al.
7,181,949 B2 * 2/2007 Haberkamm et al. ..... 72/243.6

FOREIGN PATENT DOCUMENTS

DE 197 19 318 11/1998
DE 100 37 004 2/2002

OTHER PUBLICATIONS

Patent Abstracts of Japan, BD. 018, No. 217 (M-1594), Apr. 19, 1994 & JP 06 015309 A (Sumitomo Metal Ind Ltd), Jan. 25, 1994.

* cited by examiner

*Primary Examiner*—Ed Tolan
(74) *Attorney, Agent, or Firm*—Friedrich Kueffner

(57) ABSTRACT

The invention relates to a method for the optimization of shift strategies, as a function of the strip width, for best possible usage of the advantages of CVC/CVC$^{Plus}$ technology in operation of strip-edge oriented shifts in 4-/6-roller stands, comprising a pair of working rollers and a pair of support rollers for a 4-roller stand and, in addition, a pair of intermediate rollers for a 6-roller stand, whereby at least the working rollers and the intermediate rollers cooperate with devices for axial shifting, characterized in that selection of the shift position (VP), for the shifting working/intermediate rollers, is made as a function of strip width. The working/intermediate rollers are then positioned in various positions (P), relative to the strip edge and, within differing strip width ranges (B), the shift position (VP) of each roller is given by an incremental linear progressive function.

8 Claims, 3 Drawing Sheets

TAB. 1

| B [mm] | VP [mm] | P [mm] |
|---|---|---|
| a | w | $\alpha$ |
| b | x | $\beta$ |
| c | y | $\beta$ |
| d | z | $\beta$ |
| e | z | $\chi$ |

OPTIMISED SHIFT STRATEGY AS A FUNCTION OF STRIP WIDTH

This application is a 35 USC 371 of PCT/EP04/12796, filed Nov. 11, 2004.

The invention concerns a method for optimizing shifting strategies as a function of strip width for the best possible utilization of the advantages of CVC/CVC$^{plus}$ technology in the operation of strip edge-oriented shifting in four-high and six-high rolling stands, comprising a pair of work rolls and a pair of backup rolls and, in addition, in the case of six-high rolling stands, a pair of intermediate rolls, wherein at least the work rolls and the intermediate rolls interact with axial shifting devices, and wherein each work roll and intermediate roll has a barrel lengthened by the amount of the CVC shifting stroke with a one-sided setback in the area of the barrel edge.

In the past, quality requirements for cold-rolled strip with respect to thickness tolerances, attainable final thicknesses, strip crown, strip flatness, surfaces, etc., have steadily increased. In addition, the great variety of products on the market for cold-rolled plates is leading to an increasingly varied product spectrum with respect to the material properties and the geometric dimensions. Due to this development, there has been an increasing need for more flexible plant conceptual designs and modes of operation in cold tandem trains—optimally adapted to the final product to be rolled.

The work roll diameter has a considerable influence on the achievement of a desired final thickness and the realization of certain draft distributions (pass program design), especially in the case of relatively high-strength grades. With decreasing work roll diameter, the required rolling force is reduced by more favorable flattening behavior. There are limits on diameter reduction that are related to the transmission of torques and to roll deflection. If the roll neck cross sections are inadequate for transmitting the driving torques, the work rolls can be driven by the adjacent roll by frictional engagement. Of course, in the case of a four-high rolling stand, heavy driving elements (motor, pinion gear unit, shafts) are necessary to realize a backup roll drive, and these elements make the mill more expensive. Here it makes sense to realize individual stands (usually the leading stands) as six-roll stands with intermediate roll drive.

The flatness of the strip is significantly affected not only by the vertical deflection but also by the horizontal deflection of the work rolls and intermediate rolls. The horizontal shifting of the work rolls and intermediate rolls from the center plane of the stand produces support of the set of rolls, which leads to significant reduction of the horizontal deflection.

In addition, the six-high rolling stand has an additional, rapid adjusting mechanism for the intermediate roll bending. In combination with the work roll bending, the six-high rolling stand thus has two independent adjusting mechanisms that affect the roll gap. In the first stand, rapid adaptation of the roll gap to the entering strip crown for the purpose of avoiding flatness defects is guaranteed. In the last stand, both adjusting mechanisms can be effectively used for flatness control.

For the conventional four-high and six-high stand designs, in addition to basic conceptual designs with bending systems and fixed roll cambers as adjusting mechanisms that affect the roll gap, there are basically two other stand conceptual designs that additionally affect the roll gap by the shifting of the work rolls or intermediate rolls, which are based on different effective principles:

CVC/CVC$^{plus}$ technology technology of strip edge-oriented shifting

In this regard, separate stand conceptual designs are involved, since different roll geometries are necessary.

In conventional CVC technology, as described in EP 0 049 798 B1, the barrel lengths of the shiftable rolls are always longer than the stationary unshifted rolls by the amount of the axial shifting stroke. As a result, the barrel edge of the shiftable roll cannot be pushed under the stationary roll barrel. Surface damage and markings are avoided in this way. The work rolls are generally supported over their entire length on the intermediate rolls or backup rolls. In this way, the rolling force applied by the backup rolls is transmitted to the entire length of the work rolls. As a result, the ends of the work rolls, which extend laterally beyond the rolling stock and thus are not involved in the rolling process, are deflected towards the rolling stock by the rolling force applied to them. This detrimental deflection of the work rolls causes upward bending of the middle sections of the roll. This in turn results in insufficient rolling out of the central region of the strip and excessive rolling out of the edges of the strip. These effects come into play especially when rolling conditions vary during the operation and when strips of different widths are being rolled.

By contrast, in the technology of strip edge-oriented shifting, as disclosed in DE 22 06 912 C3, rolls with the same barrel length are used in the entire set of rolls. The shiftable rolls are thus provided with a corresponding geometry at one end in the barrel edge region and with a setback to reduce locally arising load peaks. The effective principle is based on the strip edge-oriented readjustment of the barrel edge, ahead of, at, or even after the strip edge. Especially in the case of six-high rolling stands, the shifting of the intermediate rolls below the backup roll allows the effectiveness of the positive work roll bending to be influenced in a systematic way. However, the axial shifting of the rolls in this method has an unfavorable effect on the load distribution in the contact joints. With decreasing strip width, there is a serious increase in the maximum load peak of the contact force distribution.

In the patent DE 36 24 241 C2 (method for operating a rolling mill for the production of rolled strip), the two methods are combined. The objective is to make the unfavorable deflection of the work rolls under rolling force more uniform over the entire spectrum of strip widths and to increase the effectiveness of the roll bending systems while shortening the shift distances without having to interrupt the continuous rolling operation. This objective is achieved by the strip edge-oriented shifting of intermediate rolls or work rolls with an applied CVC cross section. The barrel edges of the CVC rolls are positioned-in the region of the strip edge. As in the case of the technology of the strip edge-oriented shifting, the set of rolls comprises rolls of equal barrel lengths.

The technologies under discussion involve separate stand conceptual designs, since different roll geometries are required. There is an effort to realize these technologies/modes of operation by a stand conceptual design with a geometrically identical set of rolls. The basic approach for realizing a strip edge-oriented shifting strategy exclusively of the intermediate rolls and exclusively in a 6-high rolling stand with the use of a geometrically identical set of rolls was described in detail in DE 100 37 004 A1.

The objective of the invention is to extend the strip edge-oriented shifting strategy known from DE 100 37 004

A1 to the work rolls as well in such a way that a stand conceptual design with a geometrically identical set of rolls is realized.

This objective is achieved by the characterizing features of claim 1 by predetermination of the shift position of the shiftable work roll/intermediate roll as a function of the strip width, in which the work roll/intermediate roll is positioned in different positions relative to the strip edge, and within different strip width regions, the shift position of the given roll is predetermined by a piecewise-linear step function.

Depending on the material properties, the free parameters of the step function can be variably selected in such a way that the predetermined positions relative to the strip edge are established. The strip edge-oriented shifting of the work rolls/intermediate rolls is carried out in such a way that the rolls are each symmetrically shifted relative to the neutral shift position ($s_{ZW}=0$ or $s_{AW}=0$) in the stand center by the same amount axially towards each other.

The roll configuration from CVC/CVC$^{plus}$ technology for a six-high roll stand or four-high roll stand is used as the basis for the stand conceptual design. The shiftable intermediate roll or work roll has a barrel that is longer by the CVC shifting stroke and is located symmetrically in the stand center for the neutral shift position $s_{ZW}=0$ or $s_{AW}=0$.

The work roll/intermediate roll with a longer and symmetrical barrel is used during the strip edge-oriented shifting with a cylindrical, crowned or superimposed CVC/CVC$^{plus}$ cross section. By suitable design of a one-sided setback in combination with the superimposed roll cross section and the strip width-dependent optimization of the axial shift position, the deformation behavior of the set of rolls and the effectiveness of the positive work roll bending (six-high rolling stand) can be systematically influenced. An optimum roll gap can thus be adjusted.

In addition, a curved contour (e.g., CVC/CVC$^{plus}$ cross section) can be superimposed on the cylindrical barrel of the work roll/intermediate roll. In the case of a CVC/CVC$^{plus}$ cross section, the curved contour is described by the equation $$R(x)=R_0+a_1\cdot x+a_2\cdot x^2 \ldots +a_n\cdot x^n$$

As a result of the superimposed, curved contour of the work roll/intermediate roll, the required shifting stroke can be reduced, since the beginning of the setback of the work roll/intermediate roll is positioned well before the strip edge. For one thing, the load distribution is reduced due to the greater contact length. For another, the maximum of the load distribution shifts more and more towards the stand center with decreasing strip width as a result of the CVC/CVC$^{plus}$ cross section.

During the axial shifting of the work roll/intermediate roll, the beginning of the setback is positioned outside of, at, or within the strip edge, i.e., already within the strip width. The positioning occurs as a function of the strip width and the material properties, so that the elastic behavior of the set of rolls and the effectiveness of the positive work roll bending (six-high rolling stand) can be systematically adjusted.

Barrel regions within the set of rolls are systematically shielded from the distribution of forces by optimization of the shift position of the work rolls/intermediate rolls. Deformations with negative effects that result from this are reduced, since the principle of the "ideal stand" is approached. However, the load distributions that occur in the respective contact joints increase due to the reduced contact lengths.

In addition, the opposite shifting of the CVC/CVC$^{plus}$ rolls results in the possibility of systematically influencing the strip crown as a preset adjusting mechanism. If the curved contour is selected in such a way that it produces no crown or a minimal crown in the maximum negative shift position and a maximum crown in the maximum positive shift position, then the strip width-dependent stand deformation can be partially compensated. The remainder of the deformation is compensated by the increasing effect of the positive work roll bending with decreasing strip width.

Further advantages, details and features of the invention are apparent from the following explanations of the various specific embodiments that are schematically illustrated in the drawings. For the sake of clarity, the same rolls are provided with the same reference numbers.

Figure 4A:
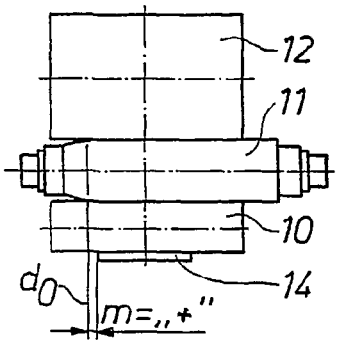
Figure 4B:
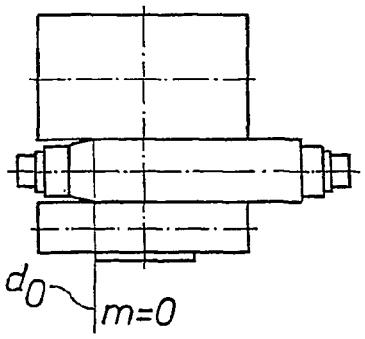
Figure 4C:
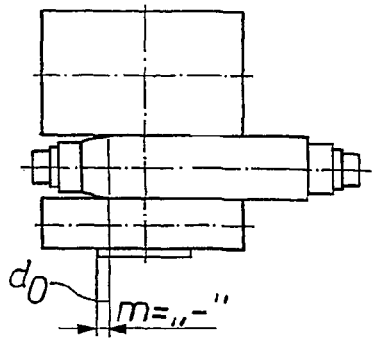

FIGS. 4*a*-4*c* show positioning of the intermediate roll setback.

Figure 5A:
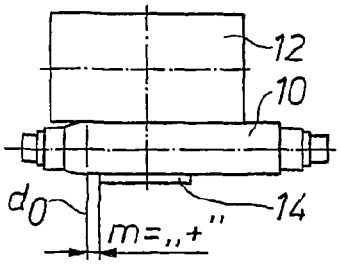
Figure 5B:
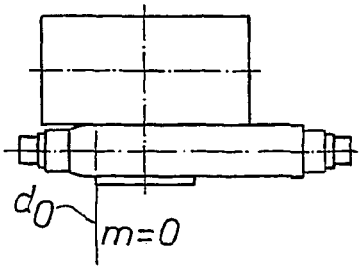
Figure 5C:
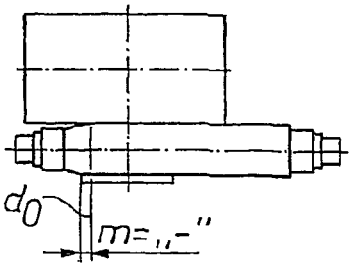

FIGS. 5*a*-5*c* show positioning of the work roll setback.

Figure 6:
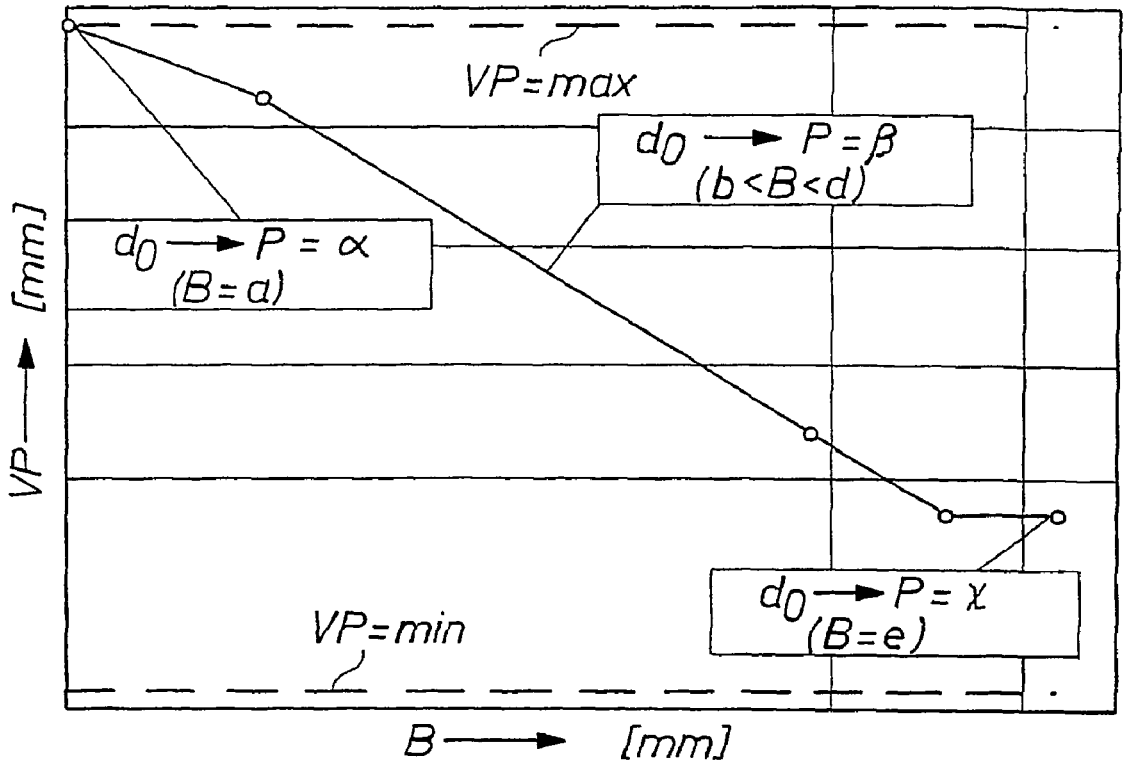

FIG. 6 shows presetting of the shift position as a function of the strip width.

Figure 1:
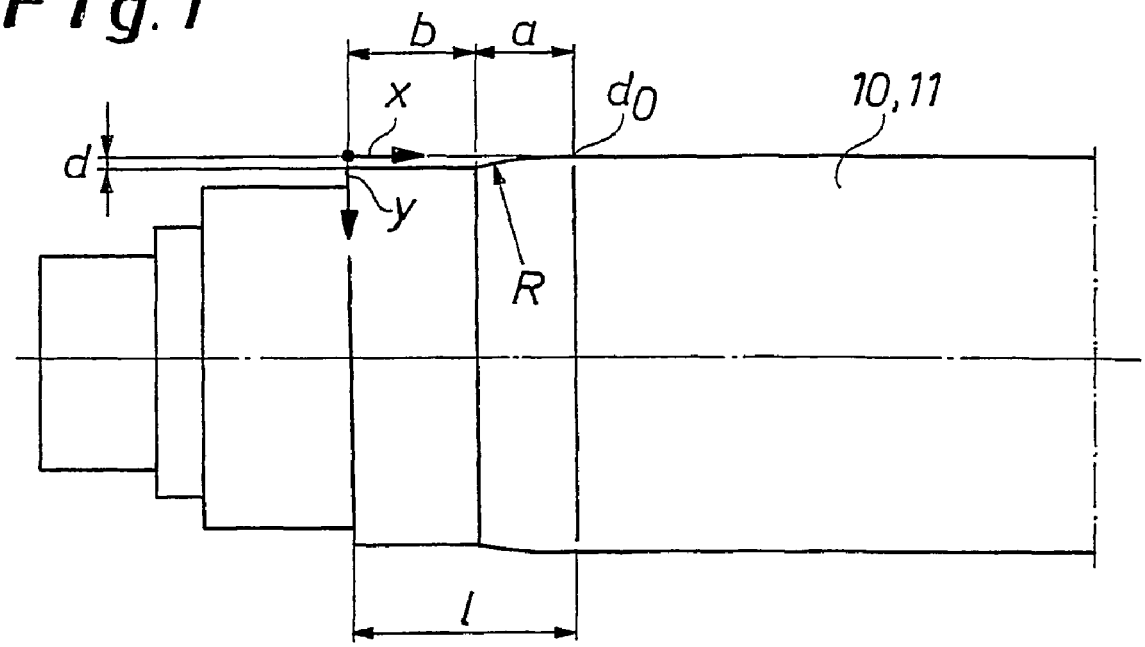
FIG. 1 shows a one-sided setback in the area of the barrel edge of a work roll/intermediate roll.

FIG. 1 shows a schematic representation of the appearance and the geometric configuration of a one-sided setback d in the region of the barrel edge of a work roll/intermediate roll 10, 11. A one-sided setback, as used here, is already described in detail and illustrated by a drawing in DE 100 37 004 A1.

The length l of the one-sided setback d in the region of a barrel edge of the work roll/intermediate roll 10, 11 is divided into two adjacent regions a and b. In the first, inner region a, beginning at point $d_0$, the setback y(x) obeys the equation of the circle $(l-x)^2+y^2=R^2$, where R is the radius of the roll. A setback y(x) of:

$$\text{Region } a := (R^2-(R-d)^2)^{1/2} \Longrightarrow y(x) = R-(R^2-(1-x)^2)^{1/2}$$

is obtained for the region a with the plotted coordinates x and y.

If a minimally necessary diameter reduction 2d, which is predetermined as a function of external boundary conditions (rolling force and the resulting roll deformation), is reached, the setback y(x) will run linearly as far as the barrel edge, so that the following is obtained for the region b:

$$\text{Region } b := 1-a \Longrightarrow y(x) = d = \text{constant}$$

The transition between region a and region b can be made with or without a continuously differentiable transition. In addition, this transition of the setback can also be made with a sequential setback of the dimension d resulting from the flattening according to a predetermined table. The setback y(x) is then flatter, for example, in the transition region than a radius and is very much steeper at the end. For reasons related to grinding technology, the transition to the cylindrical part is made with a correspondingly greater step in the transition between a and b (about 2d).

The diameter reduction 2d by the setback y(x) is made in such a way that the work roll 10 in a six-high rolling stand can bend freely by the setback y(x) of the intermediate roll 11 without any worry about contact in the region b. In a four-high rolling stand, the setback y(x) serves only for local reduction of the load peaks that arise.

The one-sided setback is normally located on the service side BS for the upper work roll/intermediate roll 10, 11 and on the drive side AS for the lower work roll/intermediate roll 10, 11. However, the effective principle remains the same if the setback is placed in the opposite way on the drive side AS for the upper work roll/intermediate roll 10, 11 and on the service side for the lower work roll/intermediate roll 10, 11.

Figure 2:
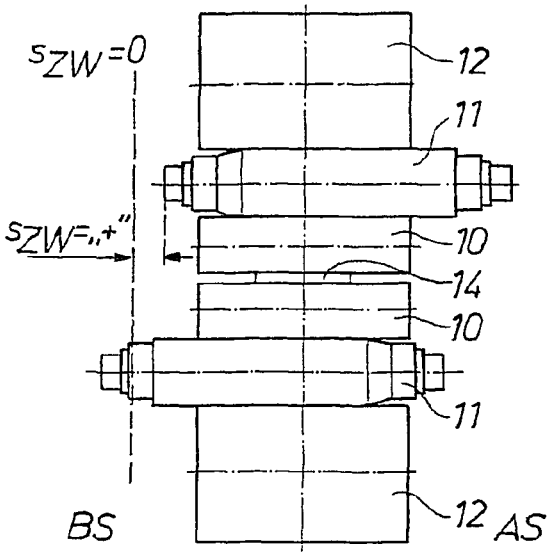
FIG. 2 shows a stand conceptual design for strip edge-oriented shifting with a superimposed CVC/CVC$^{plus}$ cross section of the intermediate rolls.

FIG. 2 shows the set of rolls of a six-high rolling stand, which consists of the work rolls 10, the intermediate rolls 11 with lengthened barrels, and the backup rolls 12. The rolled strip 14 is arranged symmetrically in the stand center. The illustrated shifting of the intermediate roll 11 by the amount $s_{ZW}$="+" means that it was shifted towards the drive side (AS). (Positive shifting means that the upper work roll/intermediate roll 10, 11 is shifted towards the drive side (AS), and the lower work roll/intermediate roll 10, 11 is shifted towards the service side (BS).)

Figure 3:
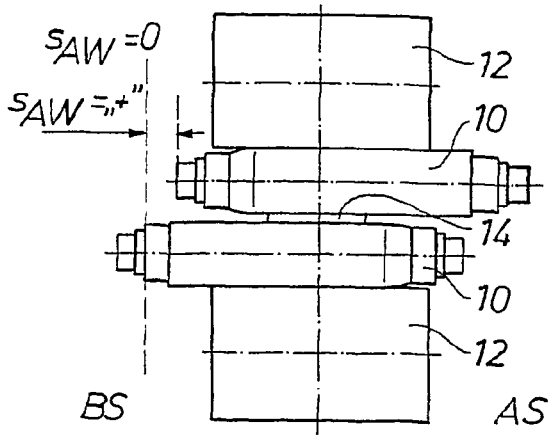
FIG. 3 shows a stand conceptual design for strip edge-oriented shifting with a superimposed CVC/CVC$^{PLUS}$ cross section of the work rolls.

FIG. 3 shows the set of rolls of a four-high rolling stand, which consists of the work rolls 10 with lengthened barrels and the backup rolls. Here again, a positive shift was carried out, namely, the work rolls 10 were shifted by the amount $s_{ZW}$="+".

In FIGS. 4*a*-4*c* and 5*a*-5*c*, the axial shifting of the work roll/intermediate roll 10, 11 by a shifting stroke m is again shown in detail. In the illustrated shift positions of FIGS. 4*a* and 5*a*, the beginning do of the setback y(x) was positioned outside the strip edge (m=+), in FIGS. 4*b* and 5*b*, it was positioned at the strip edge (m=0), and in FIGS. 4*c* and 5*c*, it was positioned inside the strip edge (m=−), i.e., already within the width of the strip.

In different strip width regions, the shift position is predetermined as a function of the strip width by piecewise-linear step functions, on which the different positions of the beginning $d_0$ of the setback relative to the strip edge are based. The shiftable work roll/intermediate roll is not positioned in the conventional way in front of the strip edge by a fixed amount m, as shown in FIGS. 4 and 5, but rather in variable positions P (α, β, χ, see Table 1) relative to the strip edge as a function of the strip width. Within various strip width regions B (a, b, c, d, e, see Table 1), the shift position VP (w, x, y, z, see Table 1) of the given roll is predetermined by a piecewise-linear step function. The free parameters of the step function are selected in such a way that the positions P relative to the strip edge that are predetermined in Table 1 become established. The shift position P of the roll is thus also obtained. The parameters can be variably predetermined as a function of the material properties.

The graph in FIG. 6 shows an example of the predetermination of the strip width-dependent shift position of the intermediate roll in a six-high rolling stand. The predetermined shift position VP in mm is plotted on the y-axis, and the strip width region B is plotted on the x-axis. The maximum shift position $VP_{max}$ and the minimum shift position $VP_{min}$, are drawn as broken lines parallel to the x-axis at the top of the graph and the bottom of the graph, respectively.

The shift positions VP obtained for various positions P can be read from this graph with the aid of Table 1 in the following way:

For a setback beginning $d_0$ on the intermediate roll at a distance P=α in mm outside the strip edge B=a in mm, a shift position VP of w in mm is obtained.

For a setback beginning $d_0$ on the intermediate roll at a distance P=β in mm outside the strip edge b<B<d in mm, a shift position VP between x and z in mm is obtained.

For a setback beginning $d_0$ on the intermediate roll at a distance P=χ in mm outside the strip edge B=e in mm, a shift position VP of z in mm is obtained.

The essential advantage of the stand conception that has been described is that with only one geometrically identical set of rolls, the CVC/$CVC^{plus}$ technology and the technology of the strip edge-oriented shifting can be realized in the manner described above. Different roll types are no longer necessary. The only differences that still exist are in the roll cross section that is provided or in a setback according to predetermined values found as described above. In addition, there is the possibility of combining the two technologies and of optimizing the deformation behavior of the rolling stand and the load distribution in the contact joints with the use of different shifting strategies (EES technology=Enhanced Shifting Strategies).

LIST OF REFERENCE SYMBOLS

10 work roll
11 intermediate roll
12 backup roll
14 rolled strip
a first, inner segment length of d
b second, outer segment length of d
d setback (corresponds to a diameter reduction of 2d)
$d_0$ beginning of d
l length of d
m shifting stroke
$s_{AW}$ amount of shift of a work roll
$s_{ZW}$ amount of shift of an intermediate roll
x, y Cartesian coordinates
AS drive side
B strip width
BS service side
P position of 10, 11 relative to the strip edge
R roll radius
$R_0$ initial roll radius
VP shift position

The invention claimed is:

1. Method for optimizing shifting strategies as a function of strip width for the best possible utilization of the advantages of CVC/$CVC^{plus}$ technology in the operation of strip edge-oriented shifting in four-high and six-high rolling stands, comprising a pair of work rolls (10) and a pair of backup rolls (12) and, in addition, in the case of six-high rolling stands, a pair of intermediate rolls (11), wherein at least the work rolls (10) and, in the case of six-high rolling stands, the intermediate rolls (11) interact with axial shifting devices, and wherein each of these intermediate rolls (10, 11) has a barrel lengthened by the amount of the CVC shifting stroke with a one-sided setback y(x) in the area of the barrel edge, wherein each work roll (10) also has a barrel lengthened by the amount of the CVC shifting stroke with a one-sided setback y(x) in the area of the barrel edge, and, in the same way as the intermediate roll (11), the work roll (10) is positioned in various positions (P) relative to the strip edge (14) by predetermination of the shift positions (VP) of the shiftable work rolls/intermediate rolls (10, 11) as a function of the strip width, and within different strip width regions (B), the shift position (VP) of the given roll is predetermined by a piecewise-linear step function.

2. Method in accordance with claim 1, wherein depending on the material properties, the free parameters of the step function can be variably selected in such a way that the predetermined positions (P) relative to the strip edge (14) are established.

3. Method in accordance with claim 1, wherein the strip edge-oriented shifting of the work rolls/intermediate rolls (10, 11) is carried out in such a way that the rolls are each symmetrically shifted relative to the neutral shift position ($s_{ZW}=0$ or $s_{AW}=0$) in the stand center by the same amount axially towards each other.

4. Rolling mill comprising four-high or six-high rolling stands in a CVC design with a pair of work rolls (10) and a pair of backup rolls (12) in the case of a four-high rolling stand and, in addition, in the case of a six-high rolling stand, a pair of intermediate rolls (11), wherein at least the work rolls (10) and the intermediate rolls (11) interact with axial shifting devices, for carrying out the method in accordance with claim 1, wherein the rolling stands have a geometrically identical set of rolls, wherein each of the shiftable work rolls/intermediate rolls (10, 11) of the rolling stands has a symmetrical barrel that is longer by the amount of the axial CVC shifting stroke and is provided with a curved roll contour with superimposed (CVC/CVC$^{plus}$ cross section) and with a one-sided setback (d).

5. Rolling mill in accordance with claim 4, wherein the curved roll contour (CVC/CVC$^{plus}$ cross section) is described by the equation $R(x)=R_0+a_1\cdot x+a_2\cdot x^2 \ldots +a_n\cdot x^n$, where $R_0$ is the initial barrel radius.

6. Rolling mill in accordance with claim 5, wherein the length (1) of the one-sided setback y(x) of the work rolls/intermediate rolls (10, 11) is divided into two adjacent regions (a) and (b), such that the first region (a), beginning with the radius ($R_0$), obeys the equation of the circle $(1-x)^2+y^2=R^2$, and the region (b) runs linearly, from which the following setback y(x) or the following diameter reduction $2\cdot y(x)$ is obtained for these regions due to the dimension resulting from the roll flattening:

$$\text{Region } a := (R^2-(R-d)^2)^{1/2} \Longrightarrow y(x) = d = R-(R^2-(1-x)^2)^{1/2}$$

$$\text{Region } b := 1-a \Longrightarrow y(x) = d = \text{constant.}$$

7. Rolling mill in accordance with claim 4, wherein the transition of the setback y(x) between the regions (a) and (b) is made with a sequential setback of the dimension (d) resulting from the roll flattening according to a predetermined table.

8. Rolling mill in accordance with claim 4, wherein the rolling stands have a geometrically identical set of rolls.

* * * * *